US011817238B2

(12) United States Patent
Lee

(10) Patent No.: US 11,817,238 B2
(45) Date of Patent: Nov. 14, 2023

(54) MAGNETIC FLUX PATH CONTROL DEVICE

(71) Applicant: UND Co., Ltd., Gyeongsangbuk-do (KR)

(72) Inventor: Cheol Su Lee, Gyeongsangbuk-do (KR)

(73) Assignee: UND CO., LTD., Gyeongsangbuk-do (KR)

( * ) Notice: Subject to any disclaimer, the term of this patent is extended or adjusted under 35 U.S.C. 154(b) by 241 days.

(21) Appl. No.: 17/299,952

(22) PCT Filed: Nov. 22, 2019

(86) PCT No.: PCT/KR2019/016110

§ 371 (c)(1),
(2) Date: Jun. 4, 2021

(87) PCT Pub. No.: WO2020/116835

PCT Pub. Date: Jun. 11, 2020

(65) Prior Publication Data

US 2021/0335529 A1 Oct. 28, 2021

(30) Foreign Application Priority Data

Dec. 7, 2018 (KR) ..... 10-2018-0156866

(51) Int. Cl.
*H01F 7/04* (2006.01)
*H01F 7/02* (2006.01)
*H01F 7/20* (2006.01)

(52) U.S. Cl.
CPC ..... *H01F 7/04* (2013.01); *H01F 7/0226* (2013.01); *H01F 7/206* (2013.01); *H01F 2007/208* (2013.01)

(58) Field of Classification Search
CPC ..... H01F 7/04; H01F 7/0226; H01F 7/206; H01F 2007/208; H01F 7/1615; H01F 3/10; H01F 7/081; H01F 2003/103
See application file for complete search history.

(56) References Cited

U.S. PATENT DOCUMENTS 9,761,362 B2 9/2017 Nätti
10,236,107 B2 3/2019 Choi
2019/0293537 A1 9/2019 Okumura et al.

FOREIGN PATENT DOCUMENTS

JP 2018-503257 A 2/2018
KR 2016 0056216 A 5/2016
(Continued)

OTHER PUBLICATIONS

International Search Report Corresponding to PCT/KR2019/016110 dated Feb. 26, 2020.
(Continued)

*Primary Examiner* — Mohamad A Musleh
(74) *Attorney, Agent, or Firm* — Finch & Maloney PLLC

(57) ABSTRACT

The present invention provides a magnetic movement path control device including: a magnetic force moving unit including a permanent magnet generating a permanent magnetic force, a first pole piece attached to a first surface of the permanent magnet, and a second pole piece attached to a second surface of the permanent magnet; a first outer pole piece in contact with the magnetic force moving unit to form a magnetic path; a second outer pole piece in contact with the magnetic force moving unit to form a magnetic path different from the magnetic path formed by the first outer pole piece; and a magnetic path control member releasing or generating the magnetic path by allowing the magnetic force moving unit to come into contact with the first outer pole piece and be spaced apart from or come in contact with the second outer pole piece, wherein the magnetic force moving unit moves between a first position where at least one of the first pole piece and the second pole piece is in contact with the first outer pole piece and the second pole piece is spaced apart from the second outer pole piece to drop a target object and a second position where at least one of the first pole piece and the second pole piece is in contact with the first
(Continued)

outer pole piece and the second pole piece is in contact with the second outer pole piece to lift the target object.

22 Claims, 10 Drawing Sheets

(56) References Cited

FOREIGN PATENT DOCUMENTS

| | | | | |
|---|---|---|---|---|
| KR | 2016 0090155 | A | | 7/2016 |
| KR | 2016 0130699 | A | | 11/2016 |
| KR | 101823228 | B1 | * | 1/2018 |
| KR | 10-2004983 | B1 | | 7/2019 |

OTHER PUBLICATIONS

Written Opinion Corresponding to PCT/KR2019/016110 dated Feb. 26, 2020.

* cited by examiner

MAGNETIC FLUX PATH CONTROL DEVICE

TECHNICAL FIELD

The present invention relates to a magnetic movement path control device capable of drop and lift control by switching a magnetic movement path, which is a movement direction of a magnetic force of a permanent magnet.

BACKGROUND ART

In general, magnetic attachment/detachment devices are mostly electromagnet-type magnetic devices, and lift or drop a target object by a magnetic force by performing on-off control of a current applied to an electromagnet in a control system to generate or release a magnetic force.

Since the magnetic attachment/detachment device does not directly apply a pressure to the target object, there is an advantage that damage to an appearance of the target object does not occur. However, since the target object has a large weight from several tens of kilograms to several tens of tons, an amount of current applied to the electromagnet increases in accordance with an increase in weight of the target object and time for which a lift of the target object is to be maintained, such that a large amount of power is consumed.

Therefore, there is a need for a magnetic attachment/detachment device that generates a magnetic force capable of maintaining the same lift force as an electromagnet-type magnetic attachment/detachment device and consumes a smaller amount of power.

In a case where a permanent magnet capable of generating the same magnetic force is used, power consumption will not occur, but the magnetic force is not released in the permanent magnet, and thus, there is a problem that it is not easy to drop the lifted target object.

In addition, in the electromagnet-type magnetic attachment/detachment device, in a case where power applied to the electromagnet is unintentionally cut off in a lift state, the magnetic force is released, such that there is a risk that the target object lifted by the magnetic attachment/detachment device may suddenly fall. Therefore, there is a problem that an expensive large power supply system such as an uninterruptible power supply (UPS), an alternating current (AC)-direct current (DC) converter for supplying large power, and a rectifier should be additionally provided.

Therefore, in order to supplement the problem of the electromagnet type, a permanent electromagnetic type has been developed. The permanent electromagnetic type is a type of generating a magnetic force by a permanent magnet at ordinary times and releasing the magnetic force when an electric current is applied, contrary to the electromagnet type.

However, the permanent electromagnetic type is not appropriate for the purpose of repeating an ON-OFF operation of a current for a short time for a lift or a drop at an instantaneous high current, and is normally capable of about 10 times of continuous ON-OFF operation of the current, but requires a period in which a current does not flow in a case of 10 times or more of ON-OFF operation of the current. In addition, there is a problem that the number of times or an operating time of magnetic force control is limited, for example, an ON-OFF operation of the current should be performed once per minute on average although it is different depending on a size of the magnet. In addition, power consumption is less than that of the electromagnet type, but the permanent electromagnetic type also has a problem that the power consumption increases in proportion to a time for maintaining a release state of the magnetic force.

DISCLOSURE

Technical Problem

The present invention has been made in an effort to solve the problem described above, and an object of the present invention is to provide a magnetic movement path control device capable of drop and lift control by switching a magnetic movement path, which is a movement direction of a magnetic force, using a permanent magnet that does not have power consumption.

Technical Solution

According to an embodiment of the present invention, a magnetic movement path control device may include: a magnetic force moving unit including a permanent magnet generating a permanent magnetic force, a first pole piece attached to a first surface of the permanent magnet, and a second pole piece attached to a second surface of the permanent magnet; a first outer pole piece in contact with the magnetic force moving unit to form a magnetic path; a second outer pole piece in contact with the magnetic force moving unit to form a magnetic path different from the magnetic path formed by the first outer pole piece; a base member in contact with an upper portion of the first outer pole piece; and a magnetic path control member releasing or generating the magnetic path by allowing the magnetic force moving unit to come into contact with the first outer pole piece and be spaced apart from or come in contact with the second outer pole piece, wherein the magnetic force moving unit moves between a first position and a second position, the first position being a drop position where at least one of the first pole piece and the second pole piece is in contact with the first outer pole piece and the second pole piece is spaced apart from the second outer pole piece to drop a target object, and the second position being a lift position where at least one of the first pole piece and the second pole piece is in contact with the first outer pole piece and the second pole piece is in contact with the second outer pole piece to lift the target object, and includes first air moving portions formed at an outer side of each of the first pole piece and the second pole piece; second air moving portions formed in an upper surface of the first outer pole piece; and third air moving portions formed in a lower surface of the base member, and when the magnetic force moving unit moves from the first position to the second position, air existing in an internal space defined by the first outer pole piece and the second outer pole piece is moved and discharged to the outside through the first air moving portions, the second air moving portions, and the third air moving portions.

Here, the first outer pole piece may form an outer surface of the magnetic movement path control device, the second outer pole piece may be installed concentrically with the first outer pole piece inside the first outer pole piece, and the magnetic force moving unit may be installed concentrically with the magnetic path control member inside the magnetic path control member.

Here, the magnetic force moving unit may have a cylindrical shape as a whole, and may have through-holes formed in central portions of the permanent magnet, the first pole piece, and the second pole piece, respectively, such that a surface area of the magnetic force moving unit is increased, and edges of the through-holes may be formed to increase a magnetic force.

Here, the magnetic movement path control device may further include a guide shaft inserted into the through-holes to move the magnetic force moving unit.

Here, the base member may include a first guide groove formed in a central portion thereof and supporting the guide shaft.

Here, the second outer pole piece may be formed in a cylindrical shape, and the second outer pole piece may include a second guide groove formed in a central portion thereof and supporting the guide shaft.

Here, the first air moving portions may be grooves formed in outer surfaces of the first pole piece and the second pole piece so as to face each other in four directions, and the second air moving portions may be holes formed radially in the upper surface of the first outer pole piece to be in communication with the first air moving portions.

Here, the third air moving portions may be grooves formed at edges of the lower surface of the base member.

Here, the third air moving portions may be formed as holes penetrating through the base member and be positioned on a straight line with the second air moving portions.

Here, the magnetic movement path control device may further include a first air pressure generating portion which is an air pressure space defined by a lower surface of the base member, an inner surface of the first outer pole piece, and an upper surface of the magnetic force moving unit, and presses the magnetic force moving unit to the second position by having the air introduced thereinto when the magnetic force moving unit moves to the second position by the magnetic path control member.

Here, the magnetic movement path control device may further include a second air pressure generating portion which is an air pressure space defined by the inner surface of the first outer pole piece, and a lower surface of the magnetic force moving unit, and an upper surface of the second outer pole piece, and presses the magnetic force moving unit to the first position by having the air introduced thereinto when the magnetic force moving unit moves to the first position by the magnetic path control member.

Here, the magnetic path control member may include a bobbin coupled to an outer side of the second outer pole piece and a coil wound around the bobbin, and the magnetic path may be changed by a direction of a current applied to the coil, such that the magnetic force moving unit is moved.

Here, the first position may be a position where the permanent magnet is in contact with the first outer pole piece and a lower surface of the magnetic force moving unit is spaced apart from an upper surface of the second outer pole piece, and the second position may be a position where the permanent magnet is in contact with the bobbin and the lower surface of the magnetic force moving unit is in contact with the upper surface of the second outer pole piece.

Here, a plane shape of the magnetic movement path control device may be a square shape.

Here, the first outer pole piece may include a plurality of sub outer pole pieces that are assembled to each other.

According to another embodiment of the present invention, a magnetic movement path control device may include: a magnetic force moving unit including a permanent magnet generating a permanent magnetic force, a first pole piece attached to a first surface of the permanent magnet, and a second pole piece attached to a second surface of the permanent magnet; a first outer pole piece in contact with the magnetic force moving unit to form a magnetic path; a second outer pole piece in contact with the magnetic force moving unit to form a magnetic path different from the magnetic path formed by the first outer pole piece; a base member in contact with an upper portion of the first outer pole piece; and a magnetic path control member releasing or generating the magnetic path by allowing the magnetic force moving unit to be spaced apart from or come into contact with the first outer pole piece and the second outer pole piece at the same time, wherein the magnetic force moving unit moves between a first position and a second position, the first position being a drop position where the first pole piece is spaced apart from the first outer pole piece and the second pole piece is spaced apart from the second outer pole piece to drop a target object, and the second position being a lift position where the first pole piece is in contact with the first outer pole piece and the second pole piece is in contact with the second outer pole piece to lift the target object, the first pole piece has a cylindrical shape and has an outer diameter that becomes narrower from the top to the bottom, the first outer pole piece has a cylindrical shape of which an inside is penetrated and has a protrusion portion formed inward at an upper side thereof, and the protrusion portion has an inner diameter that becomes narrower from the top to the bottom, and an outer circumference of the first pole piece comes into contact with the protrusion portion of the first outer pole piece in an inclined shape, such that a contact area is increased, and a magnetic force is thus increased.

Here, the magnetic force moving unit may have a cylindrical shape as a whole, and may have through-holes formed in central portions of the permanent magnet, the first pole piece, and the second pole piece, respectively, such that a surface area of the magnetic force moving unit is increased, and edges of the through-holes may be formed to increase a magnetic force.

Here, the magnetic movement path control device may further include a guide shaft inserted into the through-holes to move the magnetic force moving unit.

Here, the guide shaft may include: a guide shaft body having a cylindrical shape; a guide jaw formed at a circumference of a lower surface of the guide shaft body; guide body holes formed to penetrate through the guide shaft body; and guide jaw holes formed to penetrate through the guide jaw.

Here, the magnetic path control member may include a bobbin coupled to an outer side of the second outer pole piece and a coil wound around the bobbin, and the magnetic path may be changed by a direction of a current applied to the coil, such that the magnetic force moving unit is moved.

Here, jaws having predetermined widths may be formed inward and outward at an upper portion of the second outer pole piece, the jaw formed outward may be chamfered obliquely at a predetermined angle from an end thereof toward an edge thereof meeting an outer side portion, and the jaw formed inward may be chamfered obliquely at a predetermined angle from an edge thereof meeting an inner side portion toward a lower portion of the side portion.

Here, the magnetic movement path control device may further include: guide shaft fixing members inserted into the guide shaft body holes to couple and fix the guide shaft and the base member positioned above the guide shaft to each other, and second outer pole piece fixing members inserted into the guide jaw holes to couple and fix the guide shaft and the second outer pole piece to each other.

Advantageous Effects

With the magnetic movement path control device according to an embodiment of the present invention having the configuration described above, by switching a magnetic movement path, which is a movement direction of the magnetic force, using the permanent magnet without power consumption instead of an electromagnet consuming a large amount of power, the number of times or an operating time of magnetic force control for drop and lift is not limited, and even though a time for which a weight and a lift force of a target object are to be maintained increases, it is possible to minimize power consumption while maintaining a constant magnetic force.

In addition, in the magnetic movement path control device according to the present invention, a through-hole is formed in a central portion of the magnetic force moving unit, such that a surface area of the magnetic force moving unit is increased, and strong magnetism is formed at an edge of the through-hole, thereby increasing the entire magnetic force.

Further, the magnetic movement path control device according to the present invention includes the magnetic force moving unit having the through-hole formed in the central portion thereof and the guide shaft inserted into the through-hole to move the magnetic force moving unit, such that the magnetic force moving unit may more stably move along an outer side of the guide shaft.

Further, in the magnetic movement path control device according to the present invention, air moving portions are formed in the magnetic force moving unit, the first outer pole piece, and the base member to move air existing in an internal space between the first outer pole piece and the second outer pole piece to the outside according to the movement of the magnetic force moving unit, thereby minimizing moving resistance of the magnetic force moving unit according to an air pressure.

Further, the plane shape of the magnetic movement path control device according to the present invention is the square shape, and a plurality of magnetic movement path control devices are arranged in a matrix shape to minimize a space between the magnetic movement path control devices, thereby making it possible to efficiently use a magnetic force.

BEST MODE FOR INVENTION

Figure 1:
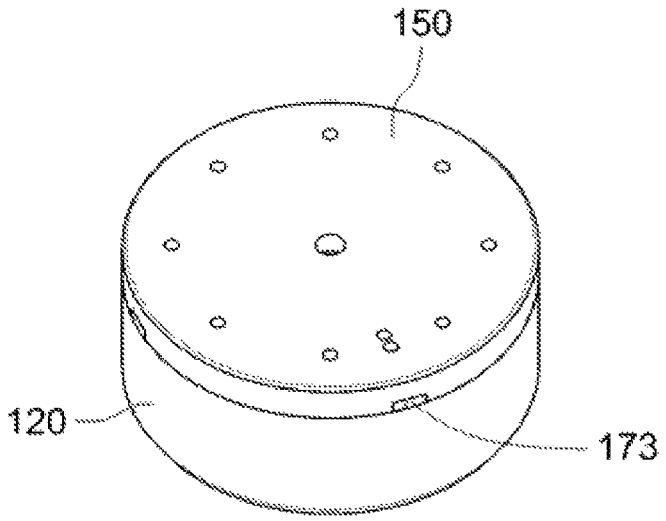
FIG. 1 is a perspective view of a magnetic movement path control device according to an embodiment of the present invention when viewed from above.

Hereinafter, magnetic movement path control devices according to exemplary embodiments of the present invention will be described in detail with reference to the accompanying drawings. Throughout the present specification, components that are the same as or similar to each other will be denoted by reference numerals that are the same as or similar to each other even though embodiments are different from each other, and a description thereof will be replaced by a first description.

Embodiments of the present invention may be modified into several forms, and it is not to be interpreted that the scope of the present invention is limited to embodiments described below. These embodiments are provided in order to describe the present invention in more detail to those skilled in the art to which the present invention pertains.

Figure 2:
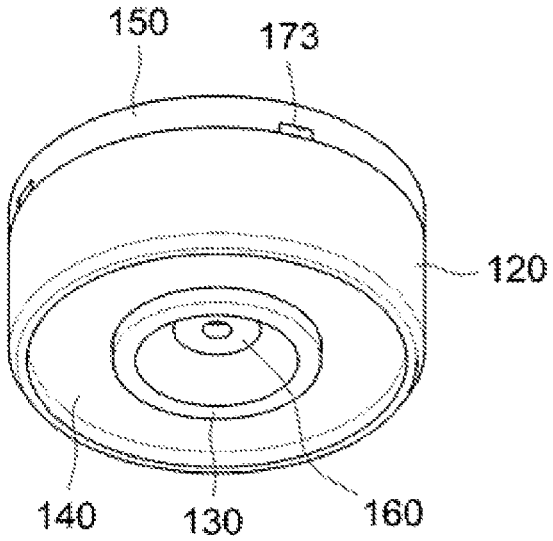
FIG. 2 is a perspective view of the magnetic movement path control device of FIG. 1 as viewed from below.
Figure 3:
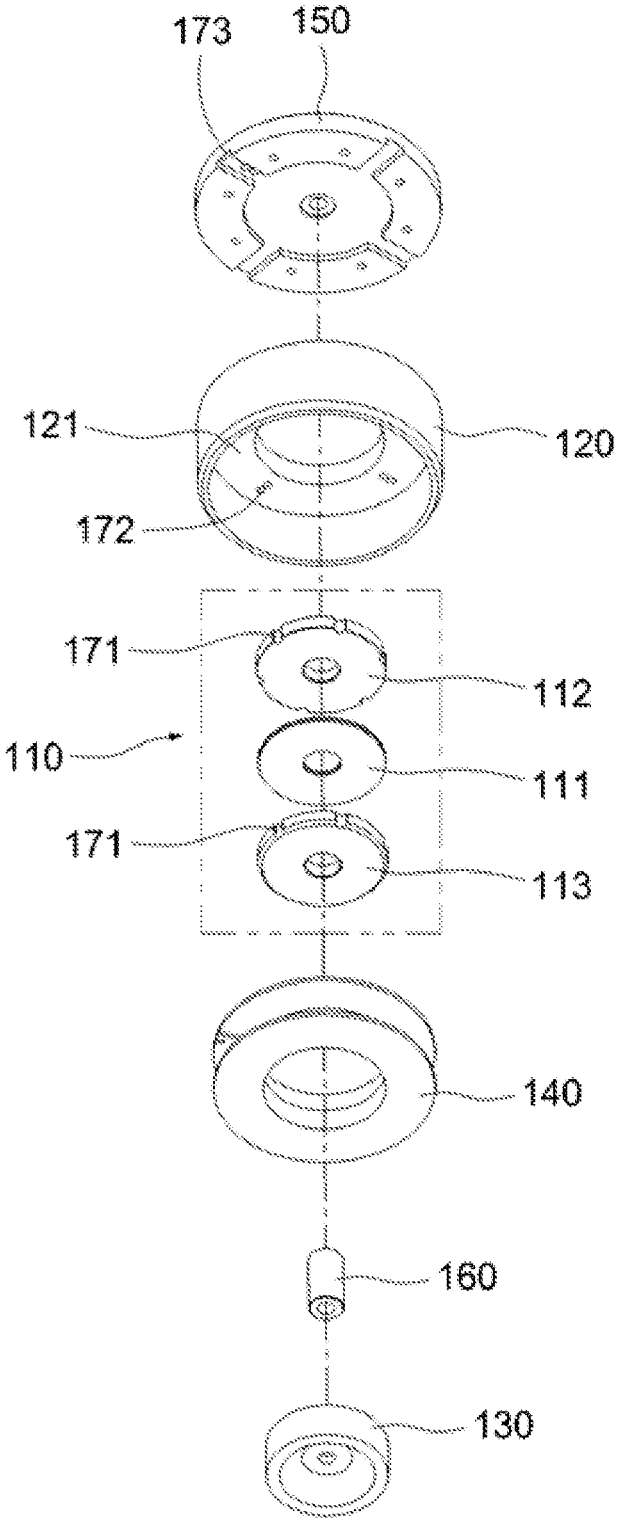
FIG. 3 is an exploded perspective view of the magnetic movement path control device of FIG. 1.

FIGS. 1 to 3, a magnetic movement path control device according to an embodiment of the present invention may include a magnetic force moving unit 110, a first outer pole piece 120, a second outer pole piece 130, a magnetic path control member 140, a base member 150, and a guide shaft 160.

The magnetic force moving unit 110 includes a permanent magnet 111, a first pole piece 112, and a second pole piece 113.

The permanent magnet 111, which generates a permanent magnetic force, may be a neodymium (Nd) magnet, but is not limited thereto, and may be magnets formed of various materials according to the purposes. In addition, the permanent magnet 111 has a through-hole formed in a central portion thereof, and has an outer side formed in a cylindrical shape. More specifically, the permanent magnet 111 is formed in a disk shape, and is formed of an S-pole disk and an N-pole disk.

The first pole piece 112, which is a ferromagnetic body, may be attached to a first surface, which is any one surface of both surfaces of the permanent magnet 111, and when the first surface of the permanent magnet 111 is an S pole, the first pole piece 112 has a polarity close to the S pole. The first pole piece 112 has a through-hole formed in a central portion thereof, and is formed in a cylindrical shape.

The second pole piece 113, which is a ferromagnetic body, may be attached to a second surface, which is the other surface of both surfaces of the permanent magnet 111, and when the second surface of the permanent magnet 111 is an N pole, the second pole piece 112 has a polarity close to the N pole. The second pole piece 113 has a through-hole formed in a central portion thereof, and is formed in a cylindrical shape.

Each of the first pole piece 112 and the second pole piece 113 and the permanent magnet 111 may be coupled to each other by a magnetic force or may be forcibly coupled to each other by a fastening means.

Therefore, the magnetic force moving unit 110 has a cylindrical shape as a whole, and the permanent magnet 111, the first pole piece 112, and the second pole piece 113 have the through-holes formed in the central portions thereof, respectively, to increase a surface area of the magnetic force moving unit 110 and allow a strong magnetism to be formed at edges of the through-holes, thereby increasing the entire magnetic force. A magnetic body has a distal end narrower than a body, and when a through-hole is formed in the magnetic body, a stronger magnetic force is formed at an edge portion of the through-hole, and the magnetic body may thus lift a target object with a greater magnetic force.

As described above, the magnetic force moving unit 110 has a through-hole formed in a central portion thereof, and the guide shaft 160 moving the magnetic force moving unit 110 is inserted into the through-hole. The guide shaft 160 has a cylindrical shape, and the magnetic force moving unit 110 stably moves along an outer side of the guide shaft 160 having the cylindrical shape. The magnetic force moving unit 110 moves without shaking leftward and rightward at the time of being moved upward and downward, by the guide shaft 160.

The first outer pole piece 120 forms an outer surface of the magnetic movement path control device, the second outer pole piece 130 is installed concentrically with the first outer pole piece 120 inside the first outer pole piece 120, and the magnetic force moving unit 110 is installed concentrically with the magnetic path control member 140 inside the magnetic path control member 140. The base member 150 is in contact with an upper portion of the first outer pole piece 120.

First air moving portions 171 are formed at outer sides of the first pole piece 112 and the second pole piece 113, second air moving portions 172 are formed in a protrusion portion 121, which is an upper portion of the first outer pole piece 120, and third air moving portions 173 are formed in a lower surface of the base member 150.

Therefore, when the magnetic force moving unit 110 moves from a first position (drop position) (see FIG. 4) to a second position (lift position) (see FIG. 5), air existing in an internal space (second air pressure generating portion A) defined by the first outer pole piece 120 and the second outer pole piece 130 is moved and discharged to the outside through the first air moving portions 171, the second air moving portions 172, and the third air moving portions 173. Meanwhile, some of such air moves to a first air pressure generating portion B. That is, the first air pressure generating portion B is a space defined by a lower surface of the base member 150, an inner surface of the first outer pole piece 120, and an upper surface of the magnetic force moving unit 110, and as the magnetic force moving unit 110 moves to the second position, air is introduced into the first air pressure generating portion B, and accordingly, presses the magnetic force moving unit 110 so as to move to the second position.

Conversely, when the magnetic force moving unit 110 moves from the second position to the first position, air existing in an upper portion (first air pressure generating portion B) of the magnetic force moving unit 110 is discharged to the outside through the third air moving portions 173. Meanwhile, some of such air moves to the second air pressure generating portion A. That is, the second air pressure generating portion A is a space defined by an upper surface of the second outer pole piece 130, a lower surface of the magnetic force moving unit 110, and an outer surface of the guide shaft 160, and as the magnetic force moving unit 110 moves to the first position, air is introduced into the second air pressure generating portion A, and accordingly, presses the magnetic force moving unit 110 so as to move to the first position.

The first air moving portions 171 are grooves formed in outer surfaces of the first pole piece 112 and the second pole piece 113 so as to face each other in four directions, and the second air moving portions 172 are holes formed radially in an upper surface of the first outer pole piece 120 to be in communication with the first air moving portions 171. Here, the magnetic path control member 140 is fixed to an outer side of the second outer pole piece 130. In this case, a space through which air may move is formed between an upper portion of the magnetic path control member 140 and the first outer pole piece 120.

The third air moving portions 173 are formed as grooves at edges of the lower surface of the base member 150. In addition, the third air moving portions 173 are formed as holes penetrating through the base member 150 and are positioned on a straight line with the second air moving portions 172.

The base member 150 having a first guide groove (not illustrated) formed in a central portion thereof and allowing the guide shaft 160 to be supported and attached is attached to the upper portion of the first outer pole piece 120. The second outer pole piece 130 is formed in a cylindrical shape, and a second guide groove (not illustrated) supporting the guide shaft 160 is formed in a central portion of the second outer pole piece 130. Therefore, the guide shaft 160 is attached and fixed between the first guide groove and the second guide groove.

Here, a moving distance (or gap) by which the magnetic force moving unit 110 may move is formed according to a length of the guide shaft 160 fixed between the base member 150 and the second outer pole piece 130. When the guide shaft 160 becomes longer, the moving distance of the magnetic force moving unit 110 increases, and when the guide shaft 160 becomes short, the moving distance of the magnetic force moving unit 110 decreases.

The length of the guide shaft 160 may be manually and automatically changed, and as the guide shaft 160 becomes longer, a distance for moving the magnetic force moving unit 110 increases, and current consumption for controlling the magnetic force moving unit 110 also increases in proportion to the distance. Therefore, the length of the guide shaft 160 needs to be adjusted.

In addition, in order to apply the principle that a larger magnetic force is formed as a width of an end portion of a conductor where a magnetic force is formed becomes smaller, a lower end portion (for example, a portion lifting a target object) of the first outer pole piece 120 is chamfered, such that the first outer pole piece 120 is formed in a shape in which a thickness of the lower end portion thereof becomes gradually smaller than a thickness of a body thereof. A chamfering manner is also applied to a lower end portion of the second outer pole piece 130. Therefore, the second outer pole piece 130 may obtain an effect of lifting the target object with a magnetic force greater than that in a case where it is not chamfered, similar to the first outer pole piece 120.

Meanwhile, the magnetic path control member 140 is coupled to the outer side of the second outer pole piece 130 to move the magnetic force moving unit 110, thereby generating or releasing a magnetic path.

The magnetic path control member 140 may include a bobbin 141 and a coil 142 wound around the bobbin 141. Alternatively, only the coil 142 excluding the bobbin 141 may be coiled and coupled to a side portion of the second outer pole piece 130 in a shape in which it may be in close contact with the side portion. In a case where only the coil 142 is used except for the bobbin 141, the coil may be impregnated in a specific insulating solution and be then solidified, in order to maintain insulation (for example, electric leakage and short-circuit prevention and waterproofing) and a coil shape.

In order to achieve an insulation (for example, electric leakage and short-circuit prevention and waterproofing) effect, the entire lower portion (which is a lower space between the first outer pole piece 120 and the second outer pole piece 130 and is the entire bottom surface) may be molded. Through molding, a waterproof and dustproof effect may be improved and the entire external shape of the magnetic movement path control device according to the present embodiment may be integrally formed. In a case where a material (for example, Cerakwool) having very low thermal conductivity at a high temperature is used as a molding material, a heat insulation effect may be excellent, and damage to the magnetic movement path control device may thus be prevented even in a case where the magnetic movement path control device lifts a high-temperature steel.

The coil 142 used in the magnetic path control member 140 has a form in which it is wound in a predetermined direction. Therefore, in a case where a current is applied to the coil, a magnetic field (for example, N pole-S pole or S pole-N pole) is generated according to a direction in which the current is applied. The second outer pole piece 130 positioned inside the coil 142 acts as a kind of core, such that a strength of the magnetic field generated in a case where the current is applied to the coil (or a coil-type bobbin) may become larger.

Depending on the direction in which the current is applied to the magnetic path control member 140, the magnetic force moving unit 110 is pushed up in an upward direction (that is, a direction in which the base member 150 is positioned) or is pulled down in a downward direction (that is, a direction in which the second outer pole piece 130 is positioned).

In a case where the magnetic force moving unit 110 is pulled down, a magnetic path is formed. That is, a magnetic path is formed between the first outer pole piece 120, the second outer pole piece 130, and a target object (not illustrated) that are in contact with the magnetic force moving unit 110. In this case, the current is supplied to the magnetic path control member 140 only for a time for forming or releasing the magnetic path, and when the magnetic path is formed or the release of the magnetic path is completed, the current supplied to the magnetic path control member 140 is blocked. In this case, the current supplied to the magnetic path control member 140 is a direct current (DC) current.

Hereinafter, a manner in which the magnetic movement path control device described above operates will be described in detail.

Figure 4:
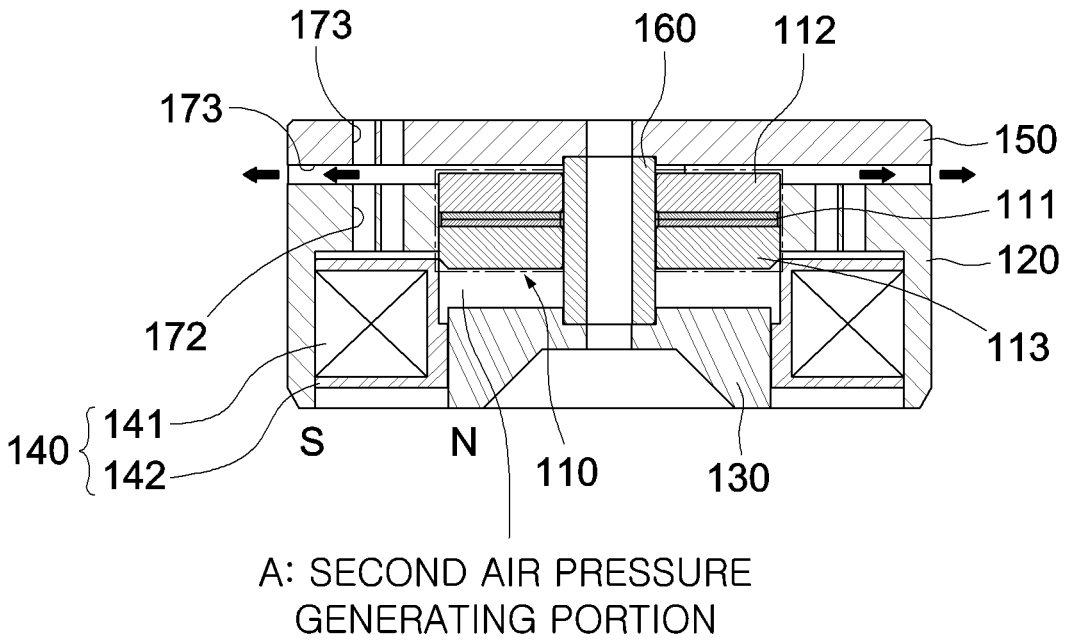
FIG. 4 is a cross-sectional view illustrating a drop state of the magnetic movement path control device of FIG. 1.

Referring to FIG. 4, the magnetic force moving unit 110 moves between the first position where at least one of the first pole piece 112 and the second pole piece 113 is in contact with the first outer pole piece 120 and the second pole piece 113 is spaced apart from the second outer pole piece 130 and the second position where at least one of the first pole piece 112 and the second pole piece 113 is in contact with the first outer pole piece 112 and the second pole piece 113 is in contact with the second outer pole piece 130, by the control of the magnetic path control member 140.

Referring to the first position of FIG. 4, the magnetic force moving unit 110 moves upward by the control of the magnetic path control member 140, such that the first pole piece 112 comes into close contact with a lower portion of the base member 150.

In this case, the outer surfaces of the first pole piece 112 and the second pole piece 113 are in contact with an inner side protruding from an upper portion of the second outer pole piece, and a lower portion of the second pole piece 113 is spaced apart from the upper portion of the second outer pole piece 130, such that a magnetic path is not formed below the first outer pole piece 120 and the second outer pole piece 130.

Meanwhile, in a process in which the magnetic force moving unit 110 moves to the drop position, air existing between the magnetic force moving unit 110 and the base member 150 may hinder the ascent of the magnetic force moving unit 110. Therefore, as the magnetic force moving unit 110 ascends, some of the air existing between the magnetic force moving unit 110 and the base member 150 rapidly moves to the third air moving portions 173 of the base member 150, such that an air pressure is removed. Some of the air moves to the second air pressure generating portion A along the first air moving portions 171 formed in a side surface of the magnetic force moving unit 110 to assist the magnetic force moving portion 110 to ascend, such that the magnetic force moving portion 110 easily ascends and moves.

Figure 5:
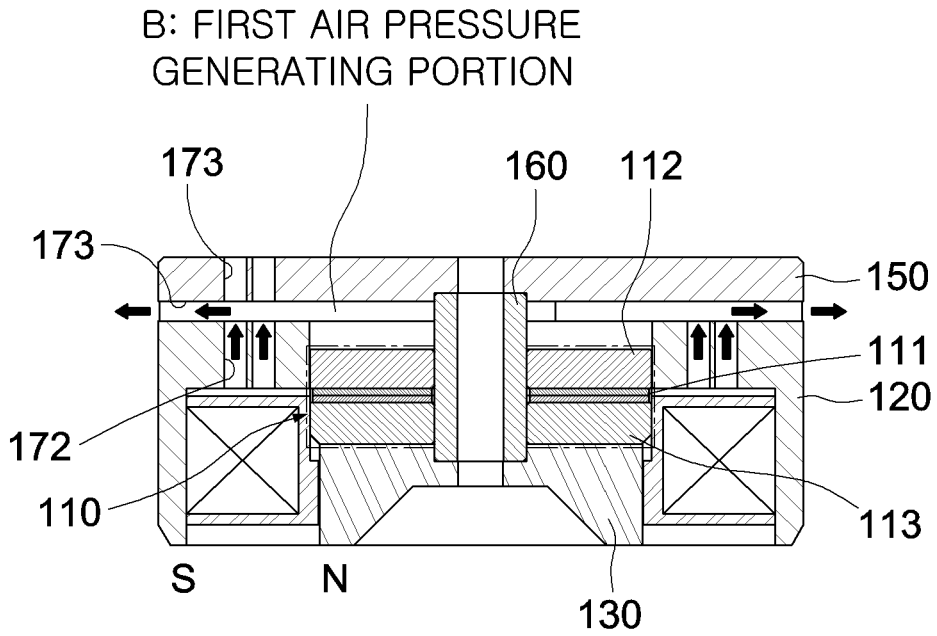
FIG. 5 is a cross-sectional view illustrating a lift state of the magnetic movement path control device of FIG. 1.

Referring to the second position of FIG. 5, the magnetic force moving unit 110 moves downward by the control of the magnetic path control member 140, such that the lower portion of the second pole piece 113 comes into close contact with the upper portion of the second outer pole piece 130.

In this case, the outer surface of the first pole piece 112 is in contact with the inner side protruding from the upper portion of the second outer pole piece, and the lower portion of the second pole piece 113 comes into contact with the upper portion of the second outer pole piece 130, such that a magnetic path (that is, a path through which a magnetic force is transferred) is formed by the first outer pole piece 120, the second outer pole piece 130, and the target object in contact with the lower portions of the first outer pole piece 120 and the second outer pole piece 130.

Meanwhile, in a process in which the magnetic force moving unit 110 moves to the lift position, air existing between the magnetic force moving unit 110 and the second pole piece 130 may hinder the descent of the magnetic force moving unit 110. Therefore, as the magnetic force moving unit 110 descends, some of the air existing between the magnetic force moving unit 110 and the second outer pole piece 130 moves to the second air moving portions 172 formed in the first outer pole piece 120 along the first air moving portions 171 formed in the side surface of the magnetic force moving unit 110, and then moves to the outside along the third air moving portions 173 formed in the base member 150, such that an air pressure is rapidly removed. Some of the air moves to the first air pressure generating portion B along the first air moving portions 171 formed in the side surface of the magnetic force moving unit 110 to assist the magnetic force moving portion 110 to descend, such that the magnetic force moving portion 110 easily descends and moves.

When the inside of the magnetic movement path control device is sealed, the magnetic movement path control device generates a considerable air pressure at the time of operating upward and downward for a time less than 1 second. When such an air pressure is not removed, a problem that on-off operation performance of the magnetic movement path control device is significantly deteriorated, and power consumption increases occurs. Therefore, in order to solve such a problem, an air moving portion capable of rapidly discharging the air pressure is required.

Figure 6:
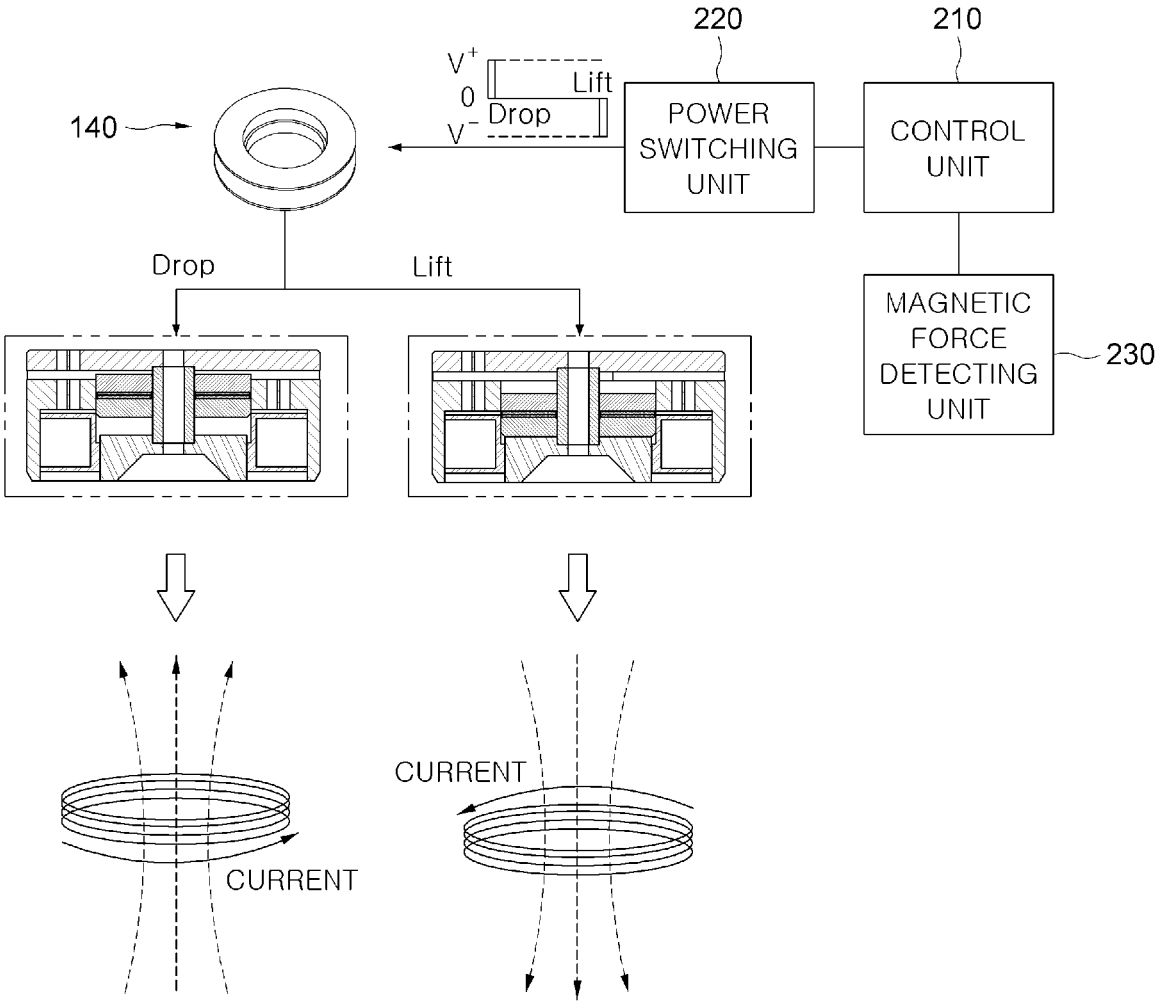
FIG. 6 is a block diagram illustrating a control structure of the magnetic movement path control device of FIG. 1.

Referring to FIG. 6, the magnetic movement path control device according to an embodiment of the present invention further includes a control unit 210, a power switching unit 220, and a magnetic force detecting unit 230.

The control unit 210 automatically generates a lift command (that is, a lift command for the target object) according to a designated process, outputs a lift signal corresponding to the lift command for a designated time (for example, 0.2 seconds), and then ends the output of the lift signal.

Alternatively, the control unit 210 receives a lift command from a user, outputs a lift signal corresponding to the lift command for a designated time (for example, 0.2 seconds), and then ends the output of the lift signal.

The power switching unit 220 outputs a DC voltage (for example, V+) of a predetermined level corresponding to the lift signal to the magnetic path control member 140.

In this case, assuming that the lift signal according to the lift command is a signal for lifting the target object to the magnetic movement path control device, as the DC voltage (for example, V+) corresponding to the lift signal is applied to the magnetic path control member 140, a magnetic field (that is, a magnetic field in a direction in which a magnetic force transferring unit is pulled down) is generated in the magnetic path control member 140. The magnetic field moves the magnetic force moving unit 110 downward (that is, toward the second outer pole piece 130).

As the magnetic force moving unit 110 moves downward, a magnetic force generated from the permanent magnet 111 forms a magnetic path by the first outer pole piece 120 and the second outer pole piece 130 that are in direct contact with the first and second pole pieces 112 and 113 closely adhered to one side and the target object (in contact with the lower portions of the first outer pole piece 120 and the second outer pole piece 130).

As the magnetic force moving unit 110 is moved downward in order to lift the target object, a gap is formed above the magnetic force moving unit 110 (that is, between the base member 150 and the magnetic force moving unit 110), such that the magnetic force of the permanent magnet 111 flows only through a magnetic path (a magnetic path formed by the magnetic force moving unit 110, the first outer pole piece 120, the second outer pole piece 130, and the target object), and magnetic movement to an upper portion (base member 150) is blocked. The gap allows the magnetic force of the permanent magnet 111 to flow only through the magnetic path formed as described above to generate an effect of enhancing a lift force for the target object.

In addition, in a case where the magnetic force moving unit 110 moves to the lift position, the permanent magnet 111 comes into contact with the bobbin 141, such that the magnetic force moving unit 110 is seated at an accurate position.

As described above, in the magnetic path control device according to the present embodiment, once the magnetic path is formed, the formed magnetic path is maintained until the magnetic path is forcibly released through the magnetic path control member 140, even though the magnetic field generated in the magnetic path control member 140 is released.

In addition, the control unit 210 automatically generates a drop command according to a designated process or receives a drop command (that is, a command for dropping the target object) from the user, outputs a drop signal for a designated time (for example, 0.2 seconds), and then ends the output of the drop signal.

The power switching unit 220 outputs a DC voltage (for example, V−) of a predetermined level corresponding to the drop signal to the magnetic path control member 140.

In this case, assuming that the drop signal according to the drop command is a signal for dropping the target object from the magnetic movement path control device, as the DC voltage (for example, V−) corresponding to the drop signal is applied to the magnetic path control member 140, a magnetic field (that is, a magnetic field in a direction in which the magnetic force moving unit 110 is pulled up) is generated in the magnetic path control member 140 to move the magnetic force moving unit 110 upward (that is, toward the base member 150).

As the magnetic force moving unit 110 moves upward, the first pole piece 112 is attached to the base member 150 by a magnetic force generated by the permanent magnet 111. In this case, a magnetic path is not formed, the first pole piece 112 is attached to the base member 150 only by a magnetic force of the magnetic force moving unit 110, and magnetic movement to a lower portion (that is, the target object) is blocked.

As described above, in the magnetic path control device according to the present embodiment, once the magnetic path is formed, the formed magnetic path is maintained until the magnetic path is forcibly released through the magnetic path control member 140, even though the magnetic field generated in the magnetic path control member 140 is released.

Figure 7:
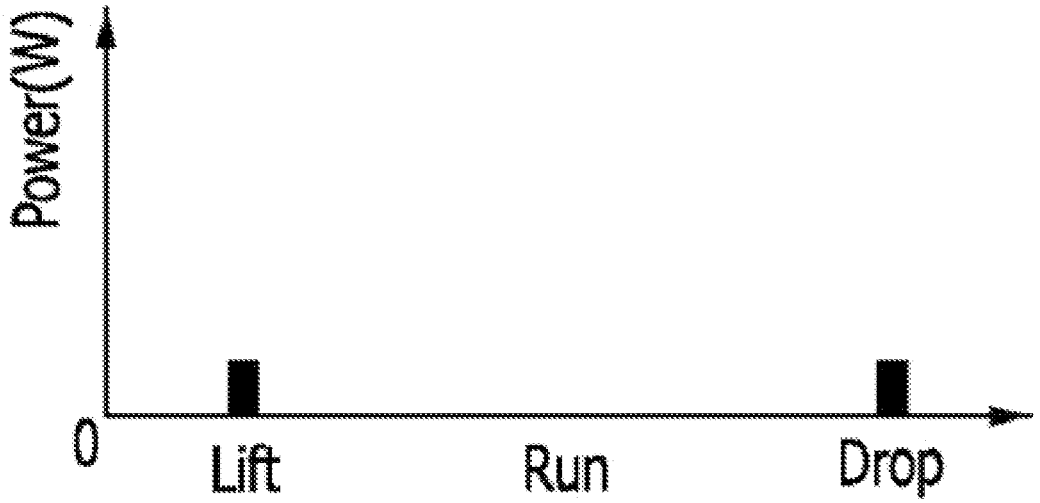
FIG. 7 is a conceptual diagram illustrating a power applying manner and a consumed power amount of the magnetic movement path control device of FIG. 1.
Figure 8:
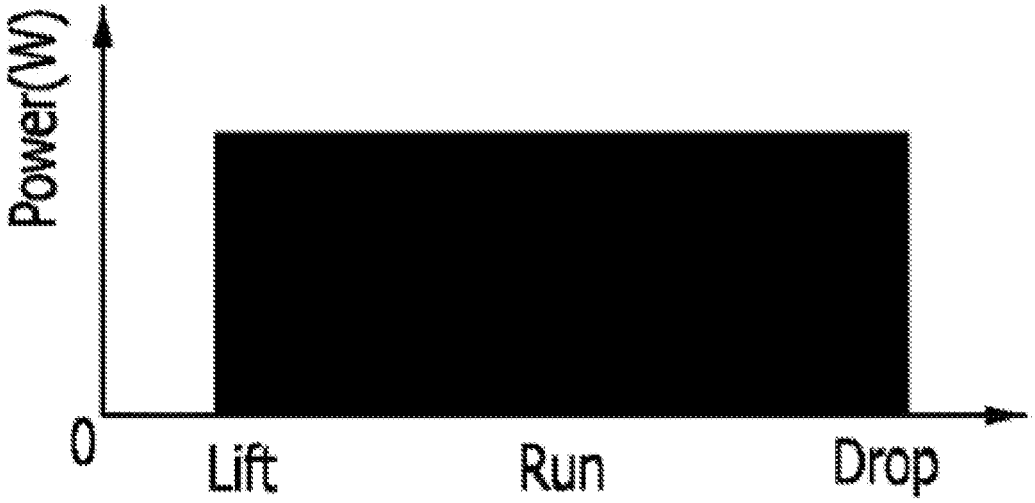
FIG. 8 is a conceptual diagram illustrating a power applying manner and a consumed power amount of an electromagnet-type magnetic attachment/detachment device according to the related art.

As described above, the magnetic movement path control device according to the present embodiment may apply power to the magnetic path control member 140 only at the moment of generating or releasing the magnetic path and continuously maintain the magnetic path even though power is not applied to the magnetic path control member 140 after generating or releasing the magnetic path, and thus, has an effect of reducing power consumption by several thousand times or more as compared with an electromagnet-type magnetic attachment/detachment device according to the related art (see FIGS. 7 and 8).

The magnetic force detecting unit 230 detects a magnetic force of the base member 150. For example, the magnetic force detecting unit 230 may include a Hall sensor.

The control unit 210 may determine that a first magnetic path (that is, a magnetic path through which a magnetic force is transferred, including the base member) is formed when the magnetic force of the base member 150 detected through the magnetic force detecting unit 230 is greater than a preset magnetic force (for example, the residual magnetic force of the base member), and may determine that a magnetic path is formed when the magnetic force of the base member 150 detected through the magnetic force detecting unit 230 is the preset magnetic force or less (for example, the residual magnetic force of the base member).

Therefore, the control unit 210 may determine generation and release of a current magnetic path using the magnetic force detected through the magnetic force detecting unit 230, and maintain an output of a signal until a desired magnetic path is formed or released to allow the magnetic path to be stably generated and released.

FIGS. 7 and 8 are illustrative views for comparing power applying manners and consumed power amounts of the magnetic movement path control device according to the present embodiment in FIG. 6 and the electromagnet-type magnetic attachment/detachment device according to the related art with each other. As a result of performing a test of lifting a target object having a weight of 1 ton and moving the target object for 3 minutes, the electromagnet-type magnetic attachment/detachment device according to the related art consumed 975 KW (FIG. 8), but the magnetic movement path control device according to the present embodiment consumed only 0.2 KW (FIG. 7). Therefore, it could be seen that the magnetic movement path control device according to the present embodiment has an effect of reducing power consumption by several thousand times or more.

This is because the magnetic movement path control device according to the present embodiment applies power to the magnetic path control member 140 only at the moment of generating the magnetic path (for example, lifting the target object) or releasing the magnetic path (for example, dropping the target object), as illustrated in FIG. 7, while in the electromagnet-type magnetic attachment/detachment device according to the related art, power is continuously consumed in the electromagnet from the time of lifting the target object to the time of dropping the target object, as illustrated in FIG. 8.

In a case where a movement time of the target object after lifting the target object is increased to be longer than a test time (3 minutes), the power consumption of the electromagnet-type magnetic attachment/detachment device according to the related art will be further increased in proportion to the increased movement time, but in the magnetic movement path control device according to the present embodiment, even though the movement time is increased, the power consumption is not further increased, such that a difference in amount of consumed power may become larger.

As described above, the magnetic movement path control device according to the present embodiment is capable of lifting and dropping the target object at an accurate point in time as in the electromagnet-type magnetic attachment/detachment device according to the related art to be very stable, and also has an effect of reducing the power consumption by several thousand times or more as compared with an electromagnet-type magnetic attachment/detachment device according to the related art.

Hereinafter, a magnetic movement path control device according to another embodiment of the present invention will be described.

Figure 9:
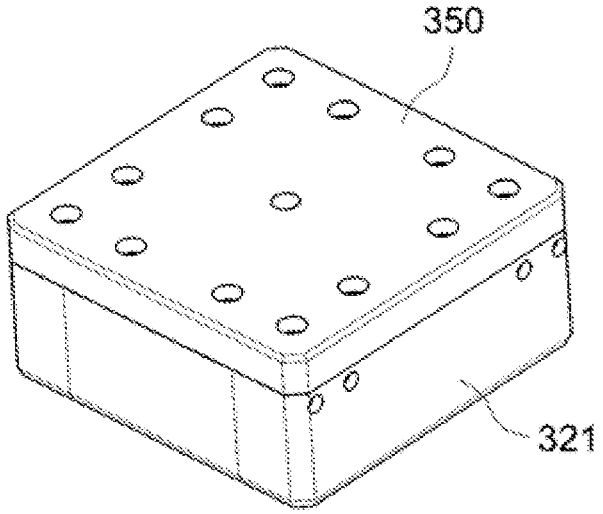
FIG. 9 is a perspective view of a magnetic movement path control device according to another embodiment of the present invention when viewed from above.
Figure 10:
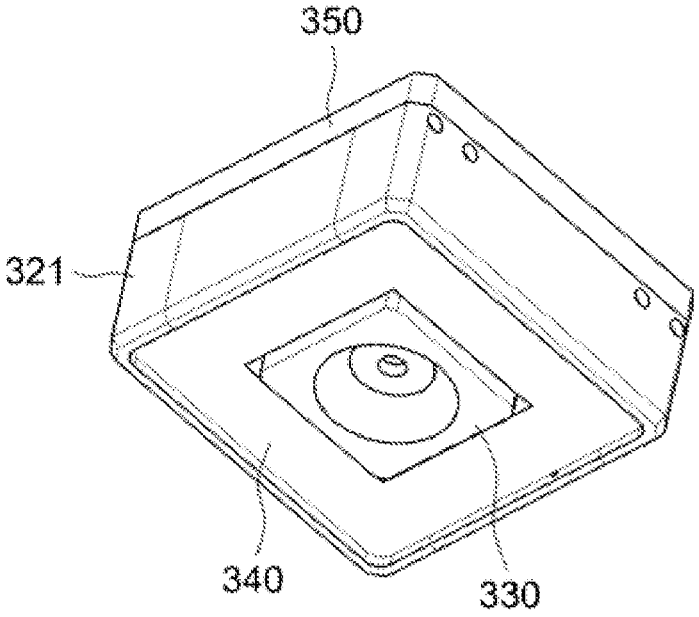
FIG. 10 is a perspective view of the magnetic movement path control device of FIG. 9 as viewed from below.
Figure 11:
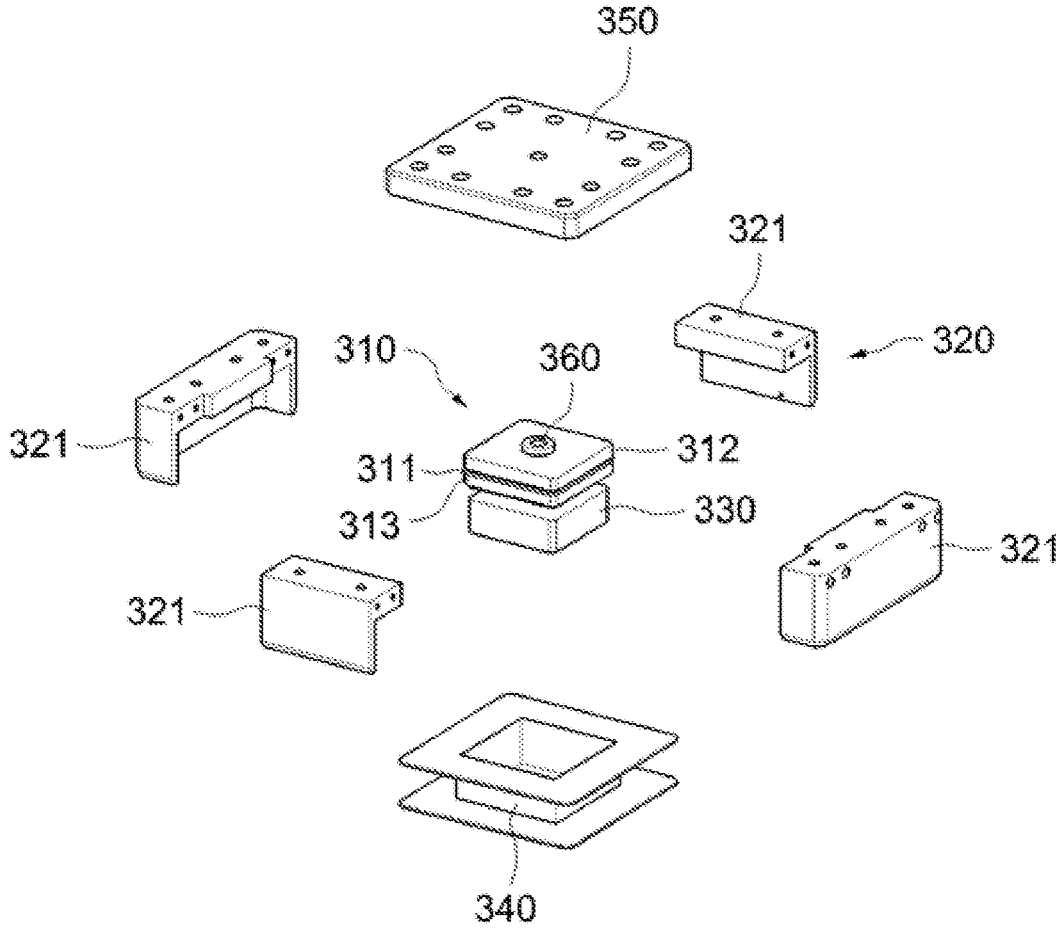
FIG. 11 is an exploded perspective view of the magnetic movement path control device of FIG. 9.

FIGS. 9 to 11, a magnetic movement path control device may include a magnetic force moving unit 310, a first outer pole piece 320, a second outer pole piece 330, a magnetic path control member 340, a base member 350, and a guide member 360.

In addition, the magnetic force moving unit 310 includes a permanent magnet 311 generating a permanent magnetic force, a first pole piece 312 attached to a first surface of the permanent magnet 311, and a second pole piece 313 attached to a second surface of the permanent magnet 311.

Functions and operations of the respective components described above are the same as those of the embodiment described above, and a description thereof will thus be omitted here.

The magnetic movement path control device according to the present embodiment has a square plane shape when viewed from above.

In addition, the magnetic force moving unit 310, the first outer pole piece 320, the second outer pole piece 330, the magnetic path control member 340, and the base member 350 have a square plane shape when viewed from above.

Here, the base member 350, the first outer pole piece 320, and the magnetic path control member 340 may have a square plane shape when viewed from above, and the second outer pole piece 330 and the magnetic force moving unit 310 may have a circular plane shape when viewed from above.

The first outer pole piece 320 includes a plurality of sub outer pole pieces 321 that may be assembled to each other.

In a case when a plurality of magnetic movement path control devices according to the present embodiment are installed, they may be installed in a matrix form, and thus, a magnetic force is efficiently used.

In a case where the magnetic movement path control device has a cylindrical shape, when the plurality of magnetic movement path control devices are installed, a space is generated between the magnetic movement path control devices, and thus, a magnetic force may not be efficiently used. Therefore, a plurality of magnetic movement path control devices having a square shape are installed, and are used to attach and detach a large target object.

Hereinafter, a magnetic movement path control device according to still another embodiment of the present invention will be described. Specific components and operations are similar to those of the embodiment described above, and contents different from those described above will thus be mainly described.

Figure 12:
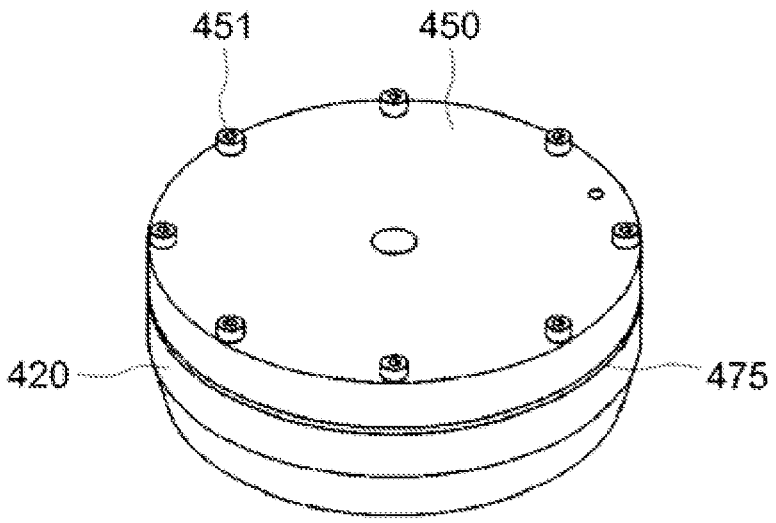
FIG. 12 is a perspective view of a magnetic movement path control device according to still another embodiment of the present invention when viewed from above.
Figure 13:
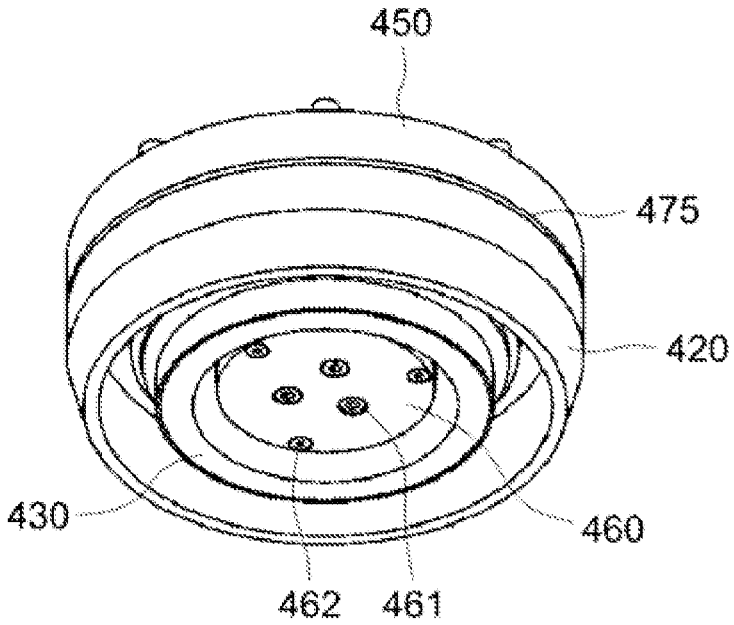
FIG. 13 is a perspective view of the magnetic movement path control device of FIG. 12 as viewed from below.
Figure 14:
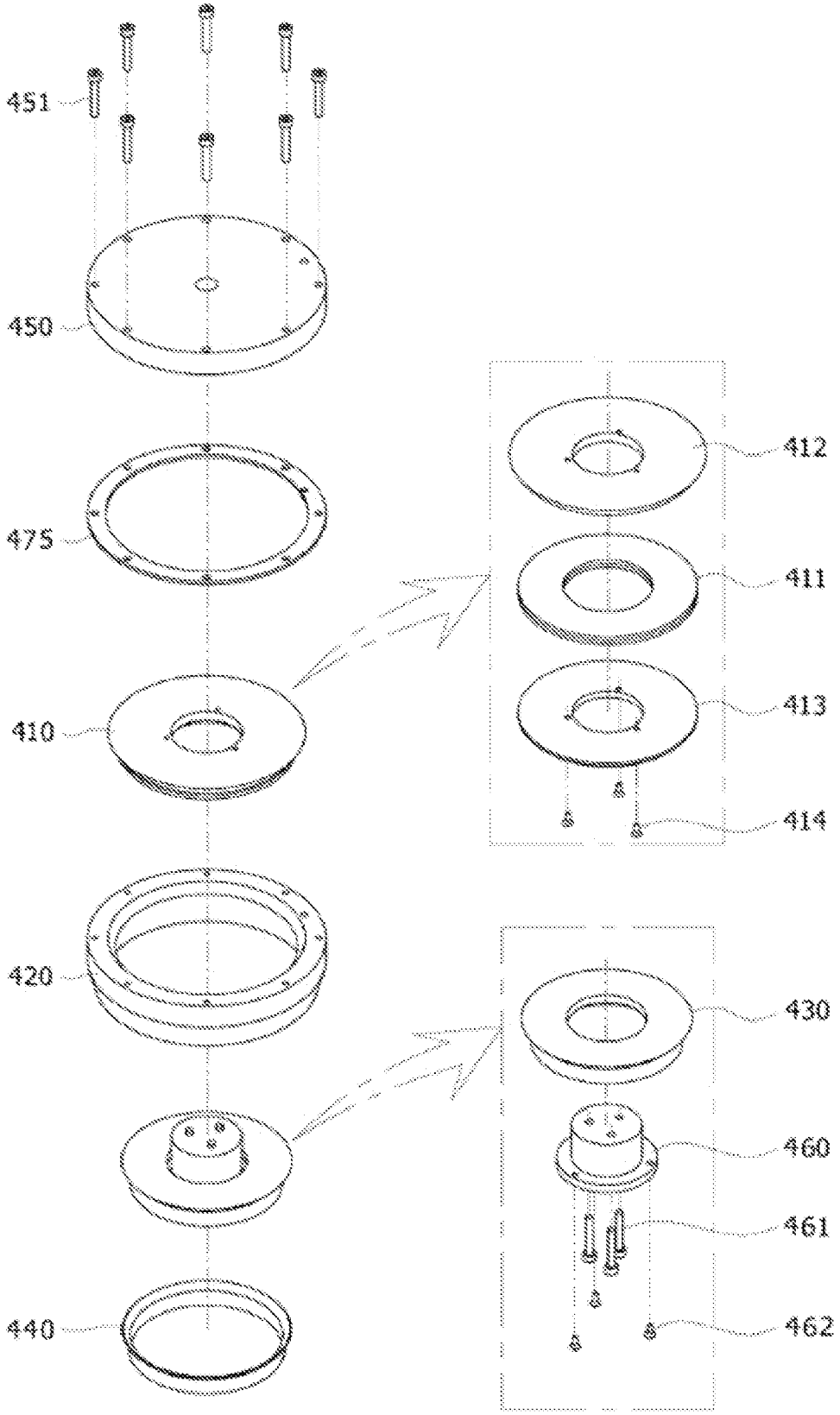
FIG. 14 is an exploded perspective view of the magnetic movement path control device of FIG. 12.

Referring FIGS. 12 to 14, a magnetic movement path control device according to still another embodiment of the present invention includes a magnetic force moving unit 410, a first outer pole piece 420, a second outer pole piece 430, and a magnetic path control member 440.

The magnetic force moving unit 410 includes a permanent magnet 411, a first pole piece 412, and a second pole piece 413. The permanent magnet 411 has a through-hole formed in a central portion thereof, and is formed in a cylindrical shape. More specifically, the permanent magnet 411 is formed in a disk shape, and is formed of an S-pole disk and an N-pole disk.

The first pole piece 412, which is a ferromagnetic body, may be attached to a first surface, which is any one surface of both surfaces of the permanent magnet 411, and when the first surface of the permanent magnet 411 is an S pole, the first pole piece 412 has a polarity close to the S pole. The first pole piece 412 has a through-hole formed in a central portion thereof, and is formed in a cylindrical shape.

The second pole piece 413, which is a ferromagnetic body, may be attached to a second surface, which is the other surface of both surfaces of the permanent magnet 411, and when the second surface of the permanent magnet 411 is an N pole, the second pole piece 413 has a polarity close to the N pole. The second pole piece 413 has a through-hole formed in a central portion thereof, and is formed in a cylindrical shape.

Here, the magnetic force moving unit 410 has a cylindrical shape as a whole, and the permanent magnet 411, the first pole piece 412, and the second pole piece 413 have the through-holes formed in the central portions thereof, respectively, such that a surface area of the magnetic force moving unit 410 increases and a strong magnetism is formed at edges of the through-holes, thereby increasing a magnetic force.

The magnetic force moving unit 410 including the permanent magnet 411, the first pole piece 412, and the second pole piece 413 has a through-hole formed in a central portion thereof, and a guide shaft 460 moving the magnetic force moving unit 410 is inserted into the through-hole. The guide shaft 460 has a cylindrical shape, and the magnetic force moving unit 410 stably moves along an outer side of the guide shaft 460 having the cylindrical shape. When there is no guide shaft 460, there is a problem that the magnetic force moving unit 410 may shake leftward and rightward at the time of moving upward and downward, but since there is a guide shaft 460, the magnetic force moving unit 410 moves without shaking leftward and rightward at the time of moving upward and downward.

The first and second pole pieces 412 and 413 and the permanent magnet 411 may be coupled to each other by a magnetic force or may be forcibly coupled to each other by a fastening means.

As features of the present embodiment, the first pole piece 412 has a cylindrical shape and has an outer diameter that becomes narrower from the top to the bottom, the first outer pole piece 420 has a cylindrical shape of which an inside is penetrated and has a protrusion portion formed inward at an upper side thereof, and the protrusion portion has an inner diameter that becomes narrower from the top to the bottom, and is in contact with or spaced apart from an outer side of the first pole piece 412.

Here, the outer side of the first pole piece 412 and an inner side of the first outer pole piece 420 face each other with an oblique inclination from the top to the bottom, such that the first pole piece 412 is easily spaced apart from an inclined surface of the inner side of the first outer pole piece 420 when the first pole piece 412 moves upward. In addition, the entire outer circumference of the first pole piece comes into contact with the entire protrusion portion of the first outer pole piece in an inclined shape, such that a contact area is increased, and a magnetic force is thus increased.

When the outer side of the first pole piece 412 and the inner side of the first outer pole piece 420 face each other in a vertical direction, movement of the first pole piece 412 is not easy due to friction between the first pole piece 412 and the first outer pole piece 420 when the first pole piece 412 moves upward.

Meanwhile, when the first pole piece 412 moves downward, the first pole piece 412 comes into contact with the inclined surface of the inner side of the first outer pole piece 420, such that the first pole piece 412 does not move downward any more, and thus, there is an advantage that a moving distance of the magnetic force moving unit 410 may be limited. Therefore, even though there is no support object supporting a lower portion of the magnetic force moving unit 410, the magnetic force moving unit 410 does not move downward any more. Therefore, there is an advantage that a moving distance of the magnetic force moving unit may be determined.

When the outer side of the first pole piece 412 and the inner side of the first outer pole piece 420 face each other in the vertical direction, if there is no support object supporting the lower portion of the magnetic force moving unit 410 when the first pole piece 412 moves downward, there is a disadvantage that a moving distance of the magnetic force moving unit becomes long. As described above, when the moving distance of the magnetic force moving unit 410 becomes excessively long, there is a problem that an amount of consumed current increases. Therefore, the moving distance needs to be determined in consideration of such a problem.

Figure 15:
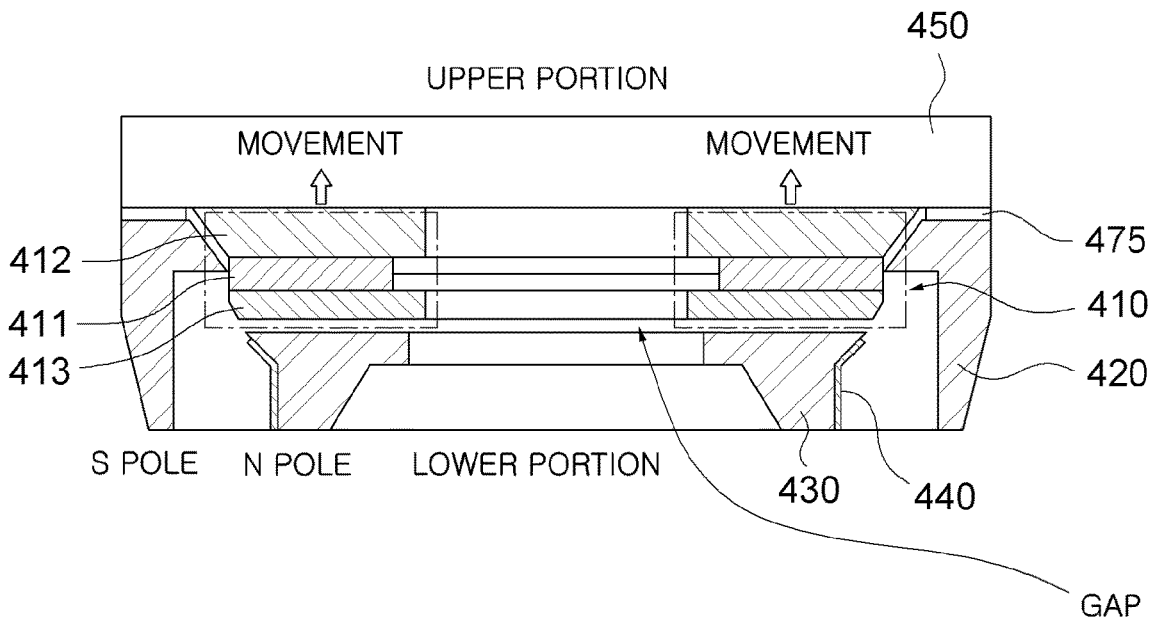
FIG. 15 is a cross-sectional view illustrating a drop state of the magnetic movement path control device of FIG. 12.

The outer side of the first pole piece 412 and an inner surface of the protrusion portion formed at the upper side of the first outer pole piece 420 face each other in an inclined state, such that when the magnetic force moving unit 410 moves upward by the control of the magnetic path control member 440, a first position where the first pole piece 412 is spaced apart from the first outer pole piece 420 and the second pole piece 413 is spaced apart from the second outer pole piece 430 is formed, and the magnetic force moving unit 410 drops the target object (see FIG. 15).

Figure 16:
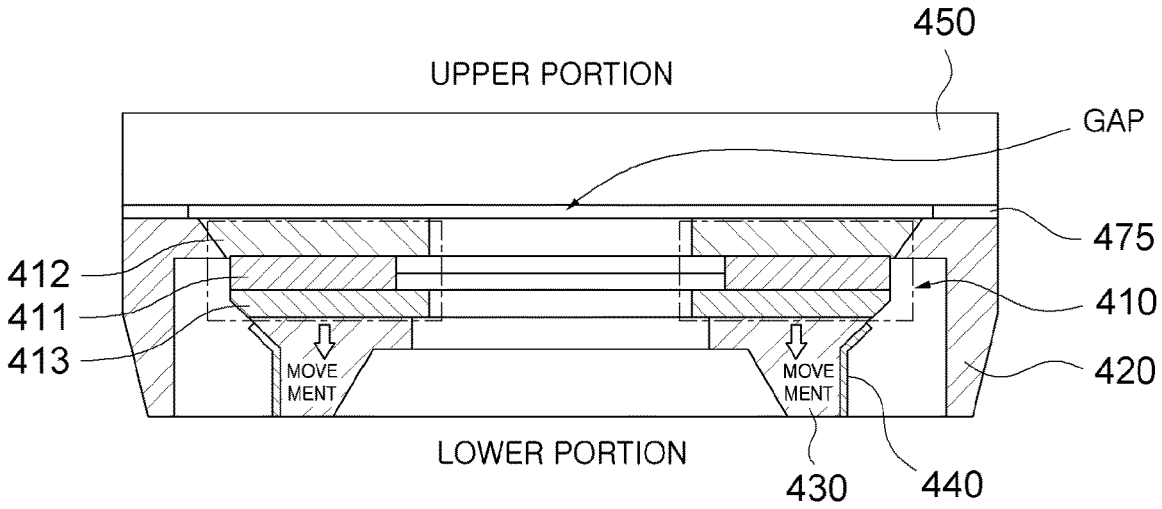
FIG. 16 is a cross-sectional view illustrating a lift state of the magnetic movement path control device of FIG. 12.

Subsequently, when the magnetic force moving unit 410 moves downward by the control of the magnetic path control member 440, a second position where the first pole piece 412 comes into contact with the first outer pole piece 420 and the second pole piece 413 comes into contact with the second outer pole piece 430 is formed, and the magnetic force moving unit 410 lifts the target object (see FIG. 16).

The magnetic movement path control device according to the present embodiment may further include first outer pole piece fixing members 451, a base member 450, a gap adjusting unit 475, magnetic force moving unit coupling members 414, guide shaft fixing members 461, and second outer pole piece fixing members 462.

The first outer pole piece fixing members 451 couple the first outer pole piece 420 to the base member 450. For example, the first outer pole piece fixing members 451 are formed in a bolt shape, and the base member 450 is formed in a disk shape.

The first outer pole piece 420, which is an outer cover (or a frame) of the magnetic movement path control device according to the present embodiment, has a cylindrical shape of which an inside is penetrated and has a protruding jaw formed inward at an upper side thereof, and a plurality of holes are formed in the jaw at regular intervals.

The plurality of holes formed in the jaw of the first outer pole piece 420 allow the first outer pole piece fixing members 451 to penetrate therethrough, thereby allowing the first outer pole piece 420 and the base member 450 to be coupled and fixed to each other using the first outer pole piece fixing members 451.

It has been illustrated in FIG. 14 that the first outer pole piece fixing members 451 are inserted and coupled into the holes from an upper portion outside the base member 450 such that the first outer pole piece fixing members 451 are exposed to the outside, but the first outer pole piece fixing members 451 may also be inserted and coupled into the holes from a lower portion inside the first outer pole piece 420 toward the base member 450, such that the first outer pole piece fixing members 451 may not be exposed to the outside. In a case where the first outer pole piece fixing members 451 are implemented so as not to be exposed to the outside, a depth of the holes formed at a lower portion of the base member 450 needs to be adjusted so that the holes do not penetrate through an upper portion of the base member 450.

As described above, in a case where the first outer pole piece fixing members 451 couple and fix the first outer pole piece 420 and the base member 450 to each other without being exposed to the outside, a dustproof and waterproof effect may be obtained, and an appearance shape may be beautiful, such that an additional effect of preventing an accident such as catching or scratching for the target object or the user may be obtained.

The guide shaft 460 includes a guide shaft body having a cylindrical shape of which an inner portion is filled, a guide jaw formed at a circumference of a lower surface of the guide shaft body, guide body holes formed to penetrate through the guide shaft body, and guide jaw holes formed to penetrate through the guide jaw.

In this case, the guide shaft fixing members 461 are inserted into the guide shaft body holes to fix the guide shaft 460 and the base member 450 to each other, and the second outer pole piece fixing members 462 are inserted into the guide jaw holes to fix the guide shaft 460 and the second outer pole piece 430 to each other.

Here, the magnetic force moving unit 410 moves upward and downward along an outer side of a cylindrical portion of the guide shaft 460. A length (or a distance or a gap) at which the magnetic force moving unit 410 may move may be adjusted according to a thickness of the gap adjusting unit 475. The gap adjusting unit 475 may be formed of a material other than a magnetic material. The gap adjusting unit 475 has a ring shape having a designated specific thickness, and is fixed and coupled between the base member 450 and the magnetic force moving unit 410.

Here, the thickness of the gap adjusting unit 475 corresponds to a length (or a distance or a gap) for moving the magnetic force moving unit 410, and is preferably, for example, 1 mm to 10 mm, but is not necessarily limited thereto. As the thickness of the gap adjusting unit 475 becomes larger, the length (or the distance or the gap) for moving the magnetic force moving unit 410 increases, and current consumption for controlling the magnetic path control member 440 increases in proportion to the length. Therefore, the thickness of the gap adjusting unit 475 needs to be adjusted in consideration of such a problem.

Meanwhile, in a case where the magnetic force moving unit 410 is controlled by the magnetic path control member 440 to move toward the base member 450 (that is, in a case where the magnetic force moving unit 410 moves in order to drop the target object), a gap corresponding to the thickness of the gap adjusting unit 475 is formed between a lower portion of the magnetic force moving unit 410 and an upper portion of the second outer pole piece 430. Therefore, a magnetic force is not transferred from the magnetic force moving unit 410 to the first outer pole piece 420 and the second outer pole piece 430 through the gap. In this case, even though the magnetic force moving unit 410 and the base member 450 are attached to each other, a magnetic path is not formed, and the magnetic force moving unit 410 and the base member 450 are in an attached state only by a magnetic force.

On the contrary, in a case where the magnetic force moving unit 410 is controlled by the magnetic path control member 440 to move toward the second outer pole piece 430 (that is, in a case where the magnetic force moving unit 410 moves in order to lift the target object), a gap corresponding to the thickness of the gap adjusting unit 475 is formed between an upper portion of the magnetic force moving unit 410 and a lower portion of the base member 450. Therefore, a magnetic path is formed between the first outer pole piece 420, the second outer pole piece 430 and the object (not illustrated) in contact with the magnetic force moving unit 410 while preventing the magnetic force from being transferred from the magnetic force moving unit 410 to the base member 450 through the gap Therefore, the target object (not illustrated) is maintained in a state in which the target object is lifted to the first outer pole piece 420 and the second outer pole piece 430 by the formed magnetic path.

That is, the gap is a space formed above or below the magnetic force moving unit 410 according to a direction in which the magnetic force moving unit 410 moves along the guide shaft 460. A magnetic force of the magnetic force moving unit 410 is prevented from being transferred to an upper portion or a lower portion by the gap.

The second outer pole piece 430 may be in contact with the lower portion of the magnetic force moving unit 410, has a through-hole formed in a central portion thereof, and is formed so that the cylindrical portion of the guide shaft 460 may pass through the through-hole.

Referring to 15 and 16, jaws having predetermined widths are formed inward and outward at the upper portion of the second outer pole piece 430, the jaw formed outward is chamfered obliquely at a predetermined angle from an end thereof toward an edge thereof meeting an outer side portion, and the jaw formed inward is chamfered obliquely at a predetermined angle from an edge thereof meeting an inner side portion toward a lower portion of the side portion.

The magnetic path control member 440 is coupled to be in close contact with an outer side of the second outer pole piece 430.

The magnetic force moving unit 410 is formed by coupling the permanent magnet 411 having the disk shape and having the through-hole formed in the central portion thereof and first and second pole pieces 412 and 413 disposed on and beneath the permanent magnet 411, respectively, integrally with each other using the magnetic force moving unit coupling members 414. Here, the first and second pole pieces 412 and 413 are formed of a magnetic material (or a ferromagnetic material), and function to transfer a magnetic force generated in the permanent magnet 411 to the upper or lower portion while minimizing loss of the magnetic force, and prevent physical damage to (or loss of magnetic force of) the permanent magnet 411 due to impact (that is, friction or impact generated at the time of moving upward and downward).

For reference, the through-hole is formed in the permanent magnet 411 to have a size greater than that of the through-holes formed in the first and second pole pieces 412 and 413, such that even though holes for the magnetic force moving unit coupling members 414 are not drilled in the permanent magnet 411 (because the magnetic force is affected in a case where the holes are drilled in the permanent magnet 411), the permanent magnet 411 is fixed between the first and second pole pieces 412 and 413 without physical damage by drilling holes only in the first and second pole pieces 412 and 413 and coupling the first and second pole pieces 412 and 413 to each other using the magnetic force moving unit coupling members 414.

All or some of the respective embodiments may be selectively combined with each other so that the embodiments described above may be variously modified. In addition, it is to be noted that the embodiments are provided in order to describe the present invention rather than limiting the present invention. Further, it may be understood by those skilled in the art to which the present invention pertains that various embodiments are possible without departing from the spirit and scope of the present invention.

INDUSTRIAL APPLICABILITY

The present invention may be applied to a field of manufacturing a magnetic movement path control device.

The invention claimed is:

1. A magnetic movement path control device comprising:

a magnetic force moving unit including a permanent magnet generating a permanent magnetic force, a first pole piece attached to a first surface of the permanent magnet, and a second pole piece attached to a second surface of the permanent magnet;

a first outer pole piece in contact with the magnetic force moving unit to form a first magnetic path;

a second outer pole piece in contact with the magnetic force moving unit to form a second magnetic path different from the first magnetic path formed by the first outer pole piece;

a base member in contact with an upper portion of the first outer pole piece; and a magnetic path control member releasing or generating the first and the second magnetic paths by allowing the magnetic force moving unit to come into contact with the first outer pole piece and be spaced apart from or come in contact with the second outer pole piece, wherein the magnetic force moving unit moves between a first position and a second position, the first position being a drop position where at least one of the first pole piece and the second pole piece is in contact with the first outer pole piece and the second pole piece is spaced apart from the second outer pole piece to drop a target object, and the second position being a lift position where at least one of the first pole piece and the second pole piece is in contact with the first outer pole piece and the second pole piece is in contact with the second outer pole piece to lift the target object, and includes first air moving portions formed at an outer side of each of the first pole piece and the second pole piece;

second air moving portions formed in an upper surface of the first outer pole piece; and third air moving portions formed in a lower surface of the base member, and when the magnetic force moving unit moves from the first position to the second position, air existing in an internal space defined by the first outer pole piece and the second outer pole piece is moved and discharged to outside the magnetic movement path control device through the first air moving portions, the second air moving portions, and the third air moving portions.

2. The magnetic movement path control device of claim 1, wherein the first outer pole piece forms an outer surface of the magnetic movement path control device, the second outer pole piece is installed concentrically with the first outer pole piece inside the first outer pole piece, and the magnetic force moving unit is installed concentrically with the magnetic path control member inside the magnetic path control member.

3. The magnetic movement path control device of claim 1, wherein the magnetic force moving unit has a cylindrical shape as a whole, and has through-holes formed in central portions of the permanent magnet, the first pole piece, and the second pole piece, respectively, such that a surface area of the magnetic force moving unit is increased, and edges of the through-holes are formed to increase a magnetic force.

4. The magnetic movement path control device of claim 3, further comprising a guide shaft inserted into the through-holes to move the magnetic force moving unit.

5. The magnetic movement path control device of claim 4, wherein the base member includes a first guide groove formed in a central portion thereof and supporting the guide shaft.

6. The magnetic movement path control device of claim 5, wherein the second outer pole piece is formed in a cylindrical shape, and the second outer pole piece includes a second guide groove formed in a central portion thereof and supporting the guide shaft.

7. The magnetic movement path control device of claim 1, wherein the first air moving portions are grooves formed in outer surfaces of the first pole piece and the second pole piece so as to face each other in four directions, and the second air moving portions are holes formed radially in the upper surface of the first outer pole piece to be in communication with the first air moving portions.

8. The magnetic movement path control device of claim 7, wherein the third air moving portions are grooves formed at edges of the lower surface of the base member.

9. The magnetic movement path control device of claim 7, wherein the third air moving portions are formed as holes penetrating through the base member and are positioned on a straight line with the second air moving portions.

10. The magnetic movement path control device of claim 1, further comprising a first air pressure generating portion which is an air pressure space defined by the lower surface of the base member, an inner surface of the first outer pole piece, and an upper surface of the magnetic force moving unit, and presses the magnetic force moving unit to the second position by having the air introduced thereinto when the magnetic force moving unit moves to the second position by the magnetic path control member.

11. The magnetic movement path control device of claim 10, further comprising a second air pressure generating portion which is an air pressure space defined by the inner surface of the first outer pole piece, and a lower surface of the magnetic force moving unit, and an upper surface of the second outer pole piece, and presses the magnetic force moving unit to the first position by having the air introduced thereinto when the magnetic force moving unit moves to the first position by the magnetic path control member.

12. The magnetic movement path control device of claim 1, wherein the magnetic path control member includes a bobbin coupled to an outer side of the second outer pole piece and a coil wound around the bobbin, and the first and the second magnetic paths are changed by a direction of a current applied to the coil, such that the magnetic force moving unit is moved.

13. The magnetic movement path control device of claim 12, wherein the first position is a position where the permanent magnet is in contact with the first outer pole piece and a lower surface of the magnetic force moving unit is spaced apart from an upper surface of the second outer pole piece, and the second position is a position where the permanent magnet is in contact with the bobbin and the lower surface of the magnetic force moving unit is in contact with the upper surface of the second outer pole piece.

14. The magnetic movement path control device of claim 1, wherein a plane shape of the magnetic movement path control device is a square shape.

15. The magnetic movement path control device of claim 14, wherein the first outer pole piece includes a plurality of sub outer pole pieces that are assembled to each other.

16. A magnetic movement path control device comprising:

a magnetic force moving unit including a permanent magnet generating a permanent magnetic force, a first pole piece attached to a first surface of the permanent magnet, and a second pole piece attached to a second surface of the permanent magnet;

a first outer pole piece in contact with the magnetic force moving unit to form a first magnetic path;

a second outer pole piece in contact with the magnetic force moving unit to form a second magnetic path different from the first magnetic path formed by the first outer pole piece;

a base member in contact with an upper portion of the first outer pole piece; and a magnetic path control member releasing or generating the first and the second magnetic paths by allowing the magnetic force moving unit to be spaced apart from or come into contact with the first outer pole piece and the second outer pole piece at the same time, wherein the magnetic force moving unit moves between a first position and a second position, the first position being a drop position where the first pole piece is spaced apart from the first outer pole piece and the second pole piece is spaced apart from the second outer pole piece to drop a target object, and the second position being a lift position where the first pole piece is in contact with the first outer pole piece and the second pole piece is in contact with the second outer pole piece to lift the target object, the first pole piece has a cylindrical shape and has an outer diameter that becomes narrower from a top to a bottom of the first pole piece, the first outer pole piece has a cylindrical shape of which an inside is penetrated and has a protrusion portion formed inward at an upper side of the first outer pole piece, and the protrusion portion has an inner diameter that becomes narrower from a top to a bottom of the protrusion portion, and an outer circumference of the first pole piece comes into contact with the protrusion portion of the first outer pole piece in an inclined shape, such that a contact area is increased, and a magnetic force is thus increased.

17. The magnetic movement path control device of claim 16, wherein the magnetic force moving unit has a cylindrical shape as a whole, and has through-holes formed in central portions of the permanent magnet, the first pole piece, and the second pole piece, respectively, such that a surface area of the magnetic force moving unit is increased, and edges of the through-holes are formed to increase a magnetic force.

18. The magnetic movement path control device of claim 17, further comprising a guide shaft inserted into the through-holes to move the magnetic force moving unit.

19. The magnetic movement path control device of claim 18, wherein the guide shaft includes:

a guide shaft body having a cylindrical shape;

a guide jaw formed at a circumference of a lower surface of the guide shaft body;

guide body holes formed to penetrate through the guide shaft body; and guide jaw holes formed to penetrate through the guide jaw.

20. The magnetic movement path control device of claim 16, wherein the magnetic path control member includes a bobbin coupled to an outer side of the second outer pole piece and a coil wound around the bobbin, and the first and the second magnetic paths are changed by a direction of a current applied to the coil, such that the magnetic force moving unit is moved.

21. The magnetic movement path control device of claim 16, wherein jaws having predetermined widths are formed inward and outward at an upper portion of the second outer pole piece, the jaw formed outward is chamfered obliquely at a predetermined angle from an end thereof toward an edge thereof meeting an outer side portion, and the jaw formed inward is chamfered obliquely at a predetermined angle from an edge thereof meeting an inner side portion toward a lower portion of the inner side portion.

22. The magnetic movement path control device of claim 19, further comprising:

guide shaft fixing members inserted into the guide shaft body holes to couple and fix the guide shaft and the base member positioned above the guide shaft to each other, and second outer pole piece fixing members inserted into the guide jaw holes to couple and fix the guide shaft and the second outer pole piece to each other.

* * * * *